United States Patent [19]

Kinoshita

[11] Patent Number: 4,912,992

[45] Date of Patent: Apr. 3, 1990

[54] STARTING DEVICE WITH PLANETARY REDUCTION GEAR

[75] Inventor: Takashi Kinoshita, Hyogo, Japan

[73] Assignee: Mitsubishi Denki Kabushiki Kaisha, Tokyo, Japan

[21] Appl. No.: 269,832

[22] PCT Filed: Mar. 1, 1988

[86] PCT No.: PCT/JP88/00228

§ 371 Date: Dec. 29, 1988

§ 102(e) Date: Dec. 29, 1988

[87] PCT Pub. No.: WO88/06683

PCT Pub. Date: Sep. 7, 1988

[30] Foreign Application Priority Data

Mar. 4, 1987 [JP] Japan ..... 62-49677

[51] Int. Cl.[4] ..... F02N 15/02; F02N 15/06

[52] U.S. Cl. ..... 74/7 A; 74/7 C; 74/7 E

[58] Field of Search ..... 74/7 A, 7 E, 7 C, 789

[56] References Cited

U.S. PATENT DOCUMENTS

| | | | |
|---|---|---|---|
| 1,951,030 | 3/1934 | Nardone | 74/7 C |
| 2,600,762 | 6/1952 | Hartz | 74/789 |
| 2,728,234 | 12/1955 | Volk, Jr. et al. | 74/7 C |
| 4,494,414 | 1/1985 | Hamano | 74/7 E |
| 4,531,429 | 7/1985 | Shutt et al. | 74/789 |
| 4,759,234 | 7/1988 | Premiski et al. | 74/789 |

FOREIGN PATENT DOCUMENTS

| | | | |
|---|---|---|---|
| 156620 | 12/1952 | Australia | 74/7 C |
| 546806 | 10/1957 | Canada | 74/789 |
| 1033697 | 7/1953 | France | 74/789 |
| 550091 | 11/1956 | Italy | 74/789 |
| 175763 | 9/1985 | Japan . | |
| 15638 | of 1902 | United Kingdom | 74/789 |
| 608288 | 9/1948 | United Kingdom | 74/789 |

*Primary Examiner*—Allan D. Herrmann
*Assistant Examiner*—Janice E. Chartoff
*Attorney, Agent, or Firm*—Sughrue, Mion, Zinn, Macpeak & Seas

[57] ABSTRACT

A plurality of planet pinions are carried on fixed shafts and mesh with a sun gear formed on an armature rotating shaft of a motor; and a cylindrical holder section of an outer clutch of an overrunning clutch device is so disposed as to cover the outer periphery of an internal gear which meshes with the planet pinions and is rotatably supported, such that the internal gear and the cylindrical holder are engaged through helical splines. Therefore, the overall length of the starting device can be decreased by the length of the helical splines formed on a conventional armature rotating shaft section or by a length exceeding it.

4 Claims, 2 Drawing Sheets

STARTING DEVICE WITH PLANETARY REDUCTION GEAR

FIELD OF THE INVENTION

The present invention relates to a starting device with a planetary reduction gear which is used for starting an internal combustion engine.

BACKGROUND OF THE INVENTION

A starting device of this type is known in the prior art as disclosed in Laid-Open Japanese Patent No. Sho 60-175763. Such a prior-art starting device 1, as shown in FIG. 1, is constituted of a DC motor 2, an overrunning clutch device 4 which is fitted slidably on an output rotating shaft 3, a planetary reduction gear 5 which transmits the rotation of an armature rotating shaft 2*a* of the DC motor 2 after speed reduction to an outer clutch 4*a* of the overrunning clutch device 4 through the output rotating shaft 3, and a shift lever 8 with its one end engaged with a plunger rod 6*a* of an electromagnetic switch device 6 disposed on the side section of the DC motor and with its other end engaged with an annular member 7 mounted on the overrunning clutch device 4 such that the overrunning clutch device 4 can slide on the output rotating shaft 3.

The planetary reduction gear 5 of the prior-art starting device 1 will be further explained. This planetary reduction gear 5 consists of a sun gear 5*a* which is formed integral with the outer peripheral section of one end of the armature rotating shaft 2*a* of the DC motor 2, an internal gear 5*b* fixed around this sun gear 5*a* positioned at center, and a plurality of planet pinions 5*e* which are in mesh with the sun gear 5*a* and the internal gear 5*b* and rotatably mounted on pins 5*d* fixed on a carrier 5*c* through sleeve bearings 5*f*. The carrier 5*c* on which each planet pinion 5*e* is mounted is formed integrally with the output rotating shaft 3, and accordingly the revolution of the planet pinions 5*d* directly becomes the rotation of the output rotating shaft 3.

The output rotating shaft 3 slidably supporting the overrunning clutch device 4 at a position adjacent to the planetary reduction gear 5 has helical splines 3*a* formed over the range of sliding of the clutch device 4 in order to transmit the rotation of the outer clutch 4*a* of the clutch device 4. Numeral 9 denotes a pinion formed on the inner clutch 4*b* of the overrunning clutch device 4. This pinion comes into engagement with a ring gear (not illustrated) of the engine when the overrunning clutch device 4 has slid on the output rotating shaft 3. As described above, the helical splines 3*a* formed on the output rotating shaft 3 are engaged with the outer clutch 4*a* of the overrunning clutch device 4 supported on this output rotation shaft 3, thereby enabling the constant transmission of a turning force to the outer clutch 4*a* while sliding the clutch device in the axial direction.

The prior-art starting device with a planetary reduction gear has such a problem that, as described above, the use of a longer output rotating shaft and consequently the starting device of increased overall length are required because of the formation of the helical splines on the output rotating shaft over the range of sliding of the clutch device to transmit rotation decelerated by the planetary reduction gear to the outer clutch 4*a* of the overrunning clutch device 4.

SUMMARY OF THE INVENTION

The present invention has been accomplished in an attempt to solve the aforementioned problem of the prior art, and it is an object of the present invention to provide a starting device having a planetary reduction gear that has a small size realized by decreasing the length of the whole body of device.

The starting device with a planetary reduction gear pertaining to the present invention has the effect that the overall length of the starting device can be decreased by designing the internal gear so as to turn without rotating each planet pinion of the planetary reduction gear, by mounting a holder section, which has been attached to the outer clutch of the overrunning clutch device, over the outer periphery of this internal gear and in mesh with the helical splines, and by mounting a shift lever for shifting the overrunning clutch device with its one end engaged with the outer peripheral section of the holder section.

BEST MODE OF THE INVENTION

Figure 1:
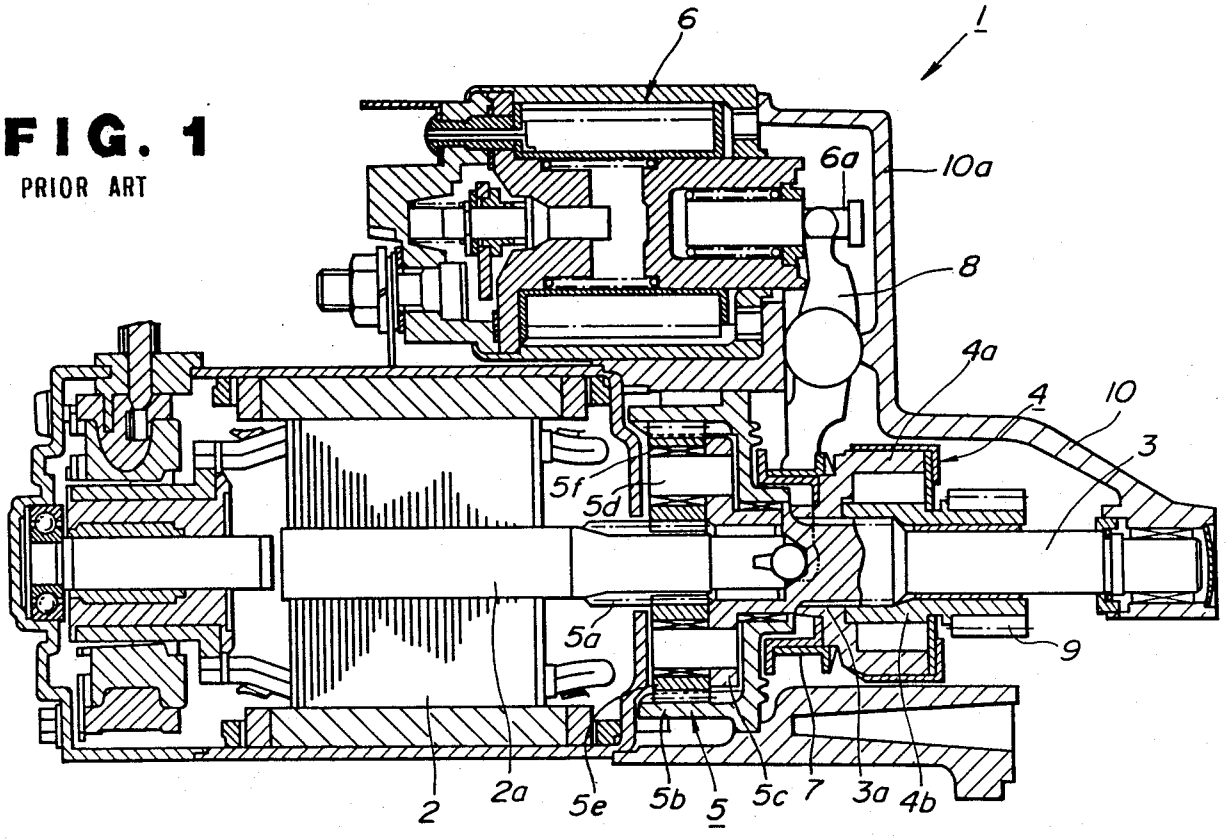
FIG. 1 PRIOR ART
FIG. 1. is a sectional view showing a prior-art starting with a planetary reduction gear.
Figure 2:
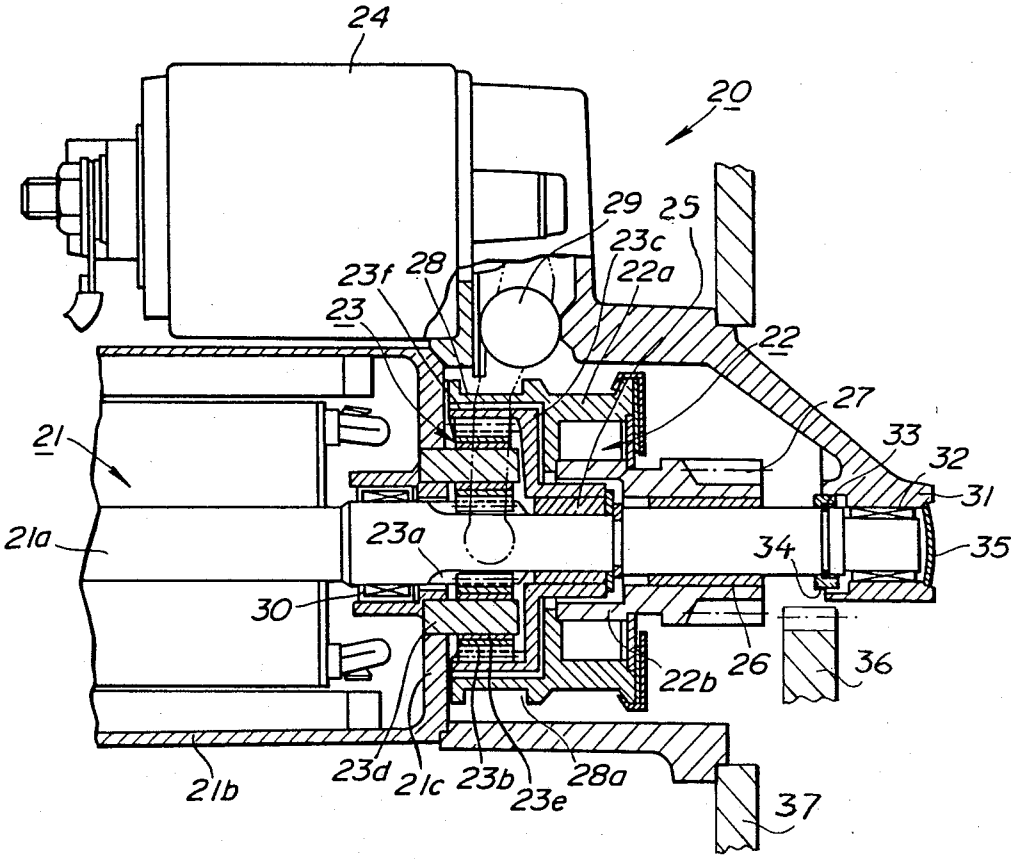
FIG. 2 is a fragmentary sectional view showing a starting device with a planetary reduction gear according to one embodiment of the present invention.

Hereinafter an embodiment of a starting device with a planetary reduction gear of the present invention will be described with reference to the accompanying drawings. FIG. 2 shows a starting device with planetary reduction gear (hereinafter referred to simply as the starting device) 20 according to one embodiment of the present invention. The starting device 20 comprises a DC motor 21, an overrunning clutch device 22 slidably fitted on an extended shaft portion of its armature rotating shaft 21, a planetary reduction gear 23 which transmits rotation to an outer clutch 22*a* of the overrunning clutch device 22 after decreasing the speed of rotation of the armature rotating shaft 21*a* of the DC motor 21, and an electromagnetic switch device 24 disposed on the side section of the DC motor 21 to slide the overrunning clutch device 22 on the extended shaft portion of the armature rotating shaft 21*a* and also to turn on the power supply to the DC motor 21.

The planetary reduction gear 23 is disposed in a position adjacent to an end wall 21*c* continuous to a casing 21*b* of the DC motor 21, and consists of a sun gear 23*a* formed on the extended shaft portion of the armature rotating shaft 21*a*, a plurality of planet pinions 23*b* disposed around, and in mesh with, the sun gear 23*a*, and an internal gear 23*c* in mesh with these planet pinions 23*b*. Each planet pinion 23*b* is rotatably supported on a bearing 23*e* on the other end of a pin fixed at one end on the end wall 21*c*, that is, a fixed shaft 23*d*. Therefore, each planet pinion 23*b* does not revolve around the sun gear 23*a*, but only revolves on the center of the fixed shaft 23*d*. Accordingly, the internal gear 23*c* which is in mesh with these planet pinions 23*b* is rotatably supported on the extended shaft portion of the armature rotating shaft 21*a* through a bearing 25 fitted between its hub and the extended shaft portion, so that rotation from the planet pinions 23*b* will be transmitted thereto.

The overrunning clutch device 22 is disposed adjacent to the planetary reduction gear 23, and is supported on a bearing 26 such that the inner clutch 22*b* is rotatable and axially slidable in relation to the extended shaft portion of the armature rotating shaft 21*a*. At the front end of this inner clutch 22*b*, a pinion 27 is formed in mesh with a ring gear (not illustrated) of the engine. On the outer clutch 22*a* of the overrunning clutch device 22, a cylindrical holder 28 is integrally formed extending out to cover the outer periphery of the internal gear 23*c* of the planetary reduction gear 23. This overrunning clutch device 22 is of a similar constitution as conventional ones except for the holder section 28 described above. The inner peripheral surface of the holder 28 is engaged with the helical splines 23*f* formed in the outer peripheral surface of the internal gear 23*c*.

In the outer peripheral surface of this holder section 28, a circumferential groove 28*a* is formed by collars jutting outwardly in the radial direction at both its ends in the axial direction. With the groove 28*a*, one end of a shift lever 29 is engaged. The other end of the shift lever 29 is engaged, as in conventional ones, with a plunger rod of the electromagnetic switch device 24.

In FIG. 2, numeral 30 designates a bearing rotatably supporting the armature rotating shaft 21*a* at the boss section of the end wall 21*c*; numeral 31 indicates a starter housing, or a front bracket; numeral 32 is a bearing supporting the end section of the extended shaft of the armature rotating shaft 21*a* in the front bracket 31; numeral 33 is a stop ring; numeral 34 is a stopper; and numeral 35 is a cap.

Next the operation of the starting device 20 of this embodiment will be explained.

When the electromagnetic switch device 24 is energized, the shift lever 29 is pivotally operated to move forward the overrunning clutch device 22 with the holder section 28 of the outer clutch held in mesh with the internal gear 23*c* through the helical splines 23*f*, then the pinion 27 goes into engagement with the ring gear 36 of the internal combustion engine 37. Immediately before or nearly simultaneously with this engagement, the main contact of the electromagnetic switch device 24 is closed, thus turning on the power supply of the DC motor 21 to rotate the armature rotating shaft 21. This rotation from the sun gear 23*a* formed on the armature rotating shaft 21*a* drives to rotate the internal gear 23*c* through the planet pinions 23*b*, and from the internal gear 23 the rotation is transmitted to the outer clutch 22*a* of the overrunning clutch device 22 through the helical splines 23*f* after internally decreasing the speed of rotation of the armature rotating shaft 21*a*. In consequence, the engine is started by the pinion 27 which is turning with the inner clutch 22*b*. The reverse transmission of the turning force to the armature rotating shaft after the starting of the engine will be shut off by the overrunning clutch device 22.

What is claimed is:

1. A starting device with planetary reduction gear, comprising: a motor which produces a rotating force to start an engine; a planetary reduction gear having a plurality of planet pinions which mesh with a sun gear formed on an armature rotating shaft of said motor, and are carried on fixed shafts, and an internal gear which meshes with said planet pinions and is rotatably supported; an overrunning clutch device that a pinion which is axially slidably supported and slides into mesh with a ring gear of the engine is formed on an inner clutch; an electromagnetic switch device disposed on the side of said motor to slide said overrunning clutch device and to supply power to said motor; a cylindrical holder section disposed on the outer periphery of said internal gear of said planetary reduction gear and in mesh with said internal gear through helical splines, that is, a cylindrical holder section formed on an outer clutch of said overrunning clutch device; and a shift lever engaged at one end with the outer periphery of said holder and at the other end with a plunger of said electromagnetic switch device.

2. A starting device with planetary reduction gear as claimed in claim 1, wherein said cylindrical holder is formed integrally with said outer clutch.

3. A starting device with planetary reduction gear as claimed in claim 1, wherein collars are provided at both ends of said cylindrical holder section and one end of said shift lever is engaged with a circumferential groove formed by said collars.

4. A starting device with planetary reduction gear as claimed in claim 1, said internal gear is rotatably supported on an extended shaft portion of said armature rotating shaft with a bearing mounted between its hub and said extended shaft portion.

* * * * *